US007687020B2

(12) United States Patent
Hardie

(10) Patent No.: US 7,687,020 B2
(45) Date of Patent: Mar. 30, 2010

(54) APPARATUS FOR INJECTING MATERIAL INTO A VESSEL

(75) Inventor: Greg Hardie, Windermere (AU)

(73) Assignee: Technological Resources Pty. Limited, Melbourne (AU)

( * ) Notice: Subject to any disclaimer, the term of this patent is extended or adjusted under 35 U.S.C. 154(b) by 0 days.

(21) Appl. No.: 11/956,588

(22) Filed: Dec. 14, 2007

(65) Prior Publication Data

US 2008/0237945 A1 Oct. 2, 2008

Related U.S. Application Data

(60) Provisional application No. 60/874,980, filed on Dec. 15, 2006.

(51) Int. Cl.
*C21C 5/32* (2006.01)

(52) U.S. Cl. ..... 266/270; 266/225

(58) Field of Classification Search ..... 266/46, 266/200, 216, 217, 225, 270
See application file for complete search history.

(56) References Cited

U.S. PATENT DOCUMENTS

2009/0014928 A1* 1/2009 Williams ..... 266/225

FOREIGN PATENT DOCUMENTS

WO WO2006/096902 * 9/2006

* cited by examiner

*Primary Examiner*—Scott Kastler
(74) *Attorney, Agent, or Firm*—Finnegan, Henderson, Farabow, Garrett & Dunner, L.L.P.

(57) ABSTRACT

An apparatus for injecting particulate and/or gaseous material into a metallurgical vessel for performing a metallurgical process is disclosed. The apparatus comprises a duct and an annular duct tip at a forward end of the duct. The apparatus also comprises inner and outer cooling water flow passages configured such that out flowing water passing from the duct tip to a rear end of the duct must travel through a longer flow path than inflowing water passing from the rear end of the duct to the duct tip.

17 Claims, 8 Drawing Sheets

APPARATUS FOR INJECTING MATERIAL INTO A VESSEL

CROSS REFERENCE TO RELATED APPLICATION

This application claims the benefit of U.S. Provisional Application No. 60/874,980, filed Dec. 15, 2006, the content of which is incorporated herein by reference.

The present invention provides an apparatus for injecting material into a vessel. The injected material may be a gas or solid particulate material.

The invention has particular, but not exclusive application to apparatus for injecting a flow of gas into a metallurgical vessel under high temperature conditions. Such metallurgical vessel may for example be a smelting vessel in which molten metal is produced by a direct smelting process.

A known direct smelting process, which relies on a molten metal layer as a reaction medium, and is generally referred to as the HIsmelt process, is described in International application PCT/AU96/00197 (WO 96/31627) in the name of the applicant.

The HIsmelt process as described in the International application comprises:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$ released from the bath in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. To promote the post combustion of reaction gases in the upper part of the vessel, a blast of hot air, which may be oxygen enriched, is injected into the upper region of the vessel through the downwardly extending hot air injection lance. To promote effective post combustion of the gases in the upper part of the vessel, it is desirable that the incoming hot air blast exit the lance with a swirling motion. To achieve this, the outlet end of the lance may be fitted with internal flow guides to impart an appropriate swirling motion. The upper regions of the vessel may reach temperatures of the order of 2000° C. and the hot air may be delivered into the lance at temperatures of the order of 1100-1400° C. The lance must therefore be capable of withstanding extremely high temperatures both internally and on the external walls, particularly at the delivery end of the lance which projects into the combustion zone of the vessel.

U.S. Pat. No. 6,440,356 discloses a gas injection lance construction designed to meet the extreme conditions encountered in the HIsmelt process. In that construction, the flow guides are in the form of spiral vanes mounted on a central body at the forward end of a gas flow duct. Those vanes are connected to the wall of the gas flow duct and are internally water cooled by cooling water which flows through supply and return passages within the wall of the duct. U.S. Pat. No. 6,673,305 discloses an alternative lance construction in which spiral flow guide vanes are mounted on a central tubular structure extending throughout the length of the gas flow duct. The central structure is provided with water flow passages which provide for the flow of cooling water to the front part of the central structure which is located generally within the tip of the gas flow duct. In that construction, the flow guide vanes are not cooled and are set back from the tip of the duct within a refractory lined wall section of the duct.

In the constructions disclosed in U.S. Pat. Nos. 6,440,356 and 6,673,305 cooling water flows to the forward end of the duct through an inner annular inflow passage in the wall of the duct and flows back from the tip to the rear end of the duct through an outer annular outflow passage. The inflowing and outflow flowing water flows longitudinally along the duct and the annular flow passages are of similar length. The present invention provides an improved construction which enables more effective cooling particularly of the outer surfaces of the duct. The invention may also be applied to the solids injection lances for injecting solid particulate material into the vessel.

According to the invention there is provided an apparatus for injecting particulate and/or gaseous material into a metallurgical vessel for performing a metallurgical process, the apparatus comprising a duct through which to inject the material;

inner and outer water flow passages extending through a wall of the duct respectively for inflow of cooling water from a rear end to a forward end of the duct and for outflow of cooling water from the forward end to the rear end of the duct; and an annular duct tip disposed at the forward end of the duct and providing a water flow connection between the inner and outer water flow passages; and wherein the inner and outer cooling water flow passages are configured such that out flowing water passing from the duct tip to the rear end of the duct must travel through a longer flow path than inflowing water passing from the rear end of the duct to the duct tip.

The material injection duct may be a gas flow duct for discharge of gas from the forward end of the duct.

Preferably the inner and outer water flow passages provide a greater total effective cross sectional area for inflowing cooling water than for out flowing water.

There may be a series of outer water cooling passages for outflow of cooling water from the tip to the rear end of the duct.

The outer water flow passages may extend in spiral paths along the duct. More specifically they may extend in a multi-start helical array extending continuously around the duct.

There may also be a series of inner water flow passages for inflow of cooling water from the rear end of the duct to the tip.

The inner water flow passages may extend in spiral paths at a greater pitch than the spirally extending outer flow passages so as to provide shorter flow paths for the inflowing water than the flow paths for the out flowing cooling water.

There may be an equal number of inner and outer water flow passages both configured to multi-start helical arrays extending continuously around the duct. There may, for example, be four inner water flow passages and four outer water flow passages connected to the inner water flow passages via the tip.

The wall of the material injection duct may be comprised of concentrically spaced apart inner, intermediate and outer tubes forming inner and outer annular spaces subdivided into the inner and outer water flow passages.

The inner annular space may be subdivided into the inner water flow passages for water inflow by inner divider bars extending spirally around and welded to the outer peripheral surface of the inner duct tube and flush fitted within the intermediate duct tube.

The outer annular space may be subdivided into the outer water flow passages for water outflow by outer divider bars extending spirally around and welded to the outer peripheral surface of the intermediate duct tube and flush fitted within the outer duct tube.

The inner annular space may be wider in the radial direction than the outer annular space and the inner divider bars may be correspondingly taller in the radial direction than the outer divider bars.

The material injection duct may be lined internally with refractory material.

A plurality of flow directing vanes may be disposed within the forward end of the duct to impart swirl to gas discharging from the duct.

The swirl vanes may be mounted on an elongate central structure extending within the gas flow duct from its rear end to its forward end.

According to the invention there is also provided a direct smelting vessel that is fitted with the above-described apparatus for injecting material into the vessel.

In order that the invention may be more fully explained, embodiments will be described in some detail with reference to the accompanying drawings in which.

Figure 1:
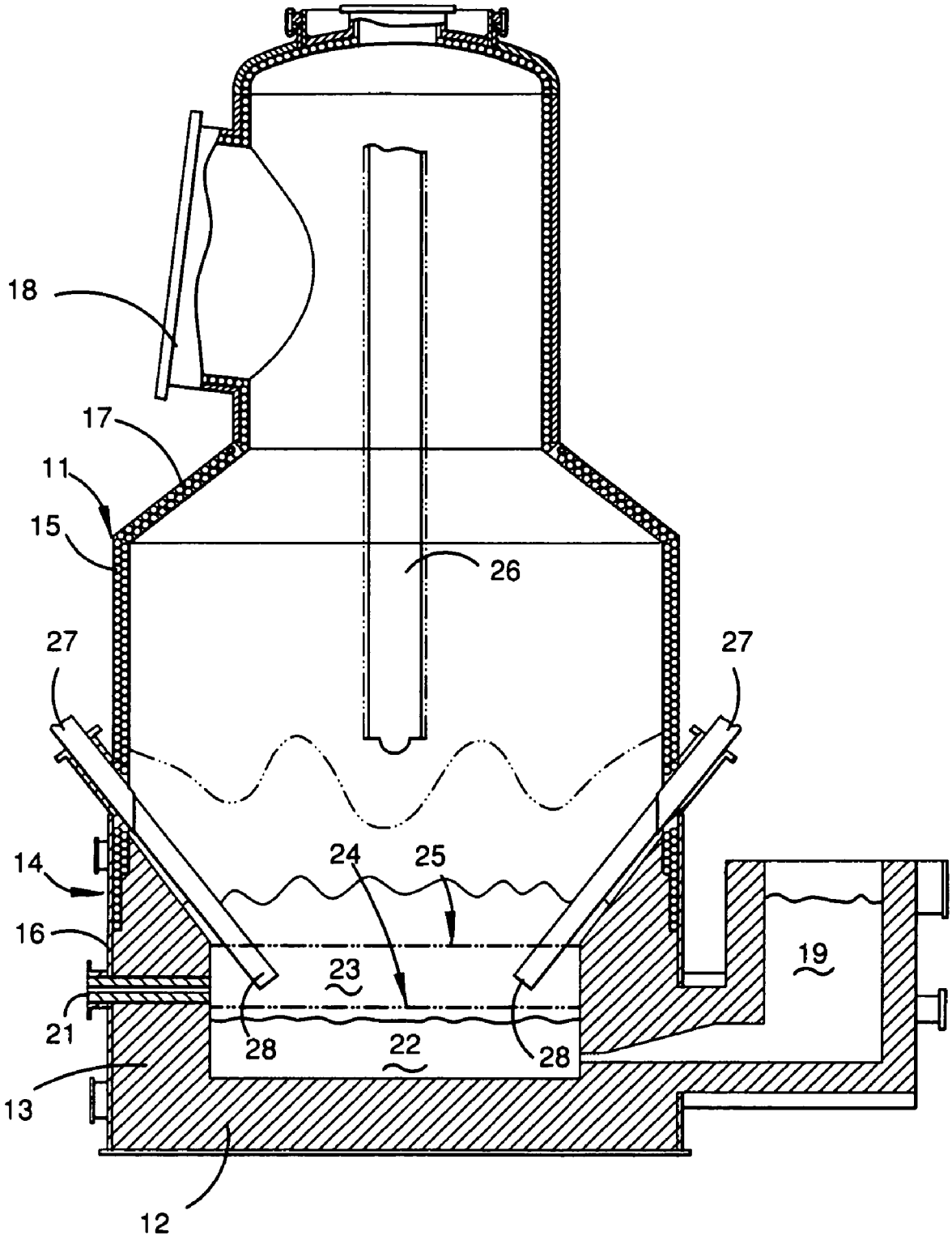
FIG. 1 is a vertical section through a direct smelting vessel incorporating one embodiment of a hot air injection lance constructed in accordance with the invention.

FIG. 1 illustrates a direct smelting vessel suitable for operation by the HIsmelt process as described in International Patent Application PCT/AU96/00197. The metallurgical vessel is denoted generally as 11 and has a hearth that includes a base 12 and sides 13 formed from refractory bricks; side walls 14 which form a generally cylindrical barrel extending upwardly from the sides 13 of the hearth and which includes an upper barrel section 15 and a lower barrel section 16; a roof 17; an outlet 18 for off-gases; a forehearth 19 for discharging molten metal continuously; and a tap-hole 21 for discharging molten slag.

In use, the vessel contains a molten bath of iron and slag which includes a layer 22 of molten metal and a layer 23 of molten slag on the metal layer 22. The arrow marked by the numeral 24 indicates the position of the nominal quiescent surface of the metal layer 22 and the arrow marked by the numeral 25 indicates the position of the nominal quiescent surface of the slag layer 23. The term "quiescent surface" is understood to mean the surface when there is no injection of gas and solids into the vessel.

The vessel is fitted with a downwardly extending hot air injection lance 26 for delivering a flow of air at a temperature in the order of 1200° C., so called "hot air blast", into an upper region of the vessel and solids injection lances 27 extending downwardly and inwardly through the side walls 14 and into the slag layer 23 for injecting iron ore, solid carbonaceous material, and fluxes entrained in an oxygen-deficient carrier gas into the metal layer 22. The position of the lances 27 is selected so that their outlet ends 28 are above the surface of the metal layer 22 during operation of the process. This position of the lances reduces the risk of damage through contact with molten metal and also makes it possible to cool the lances by forced internal water cooling without significant risk of water coming into contact with the molten metal in the vessel.

Figure 2:
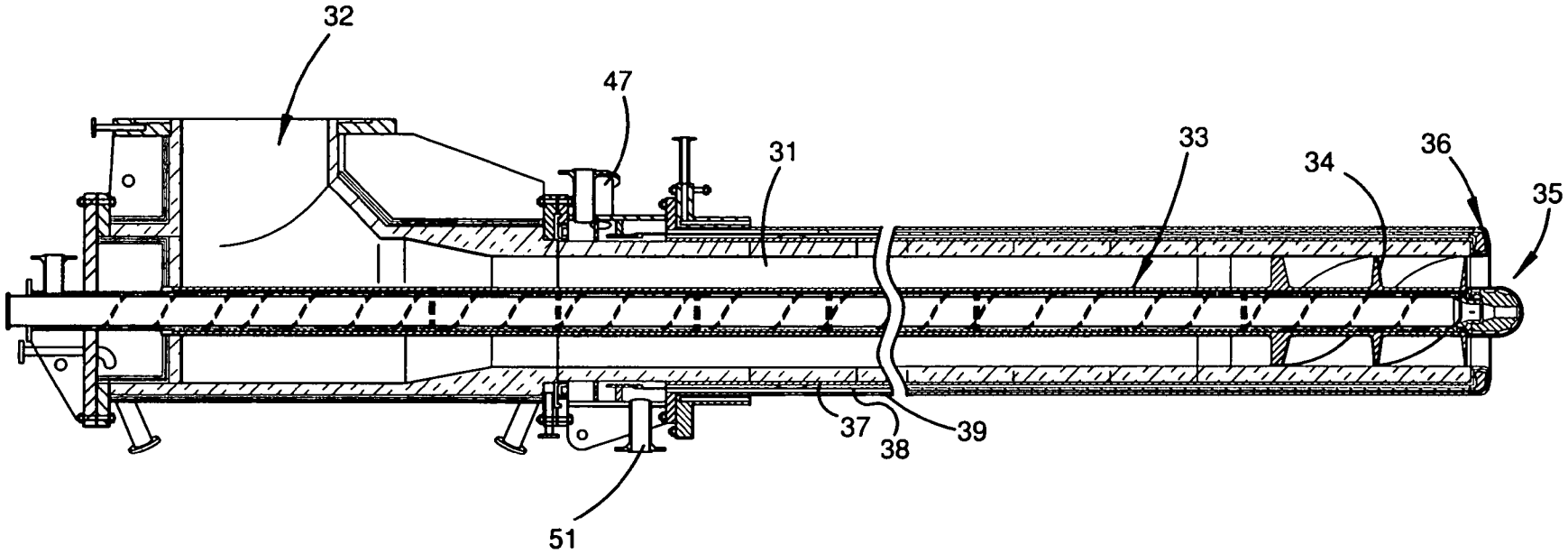
FIG. 2 is a longitudinal cross-section through the hot air injection lance.
Figure 3:
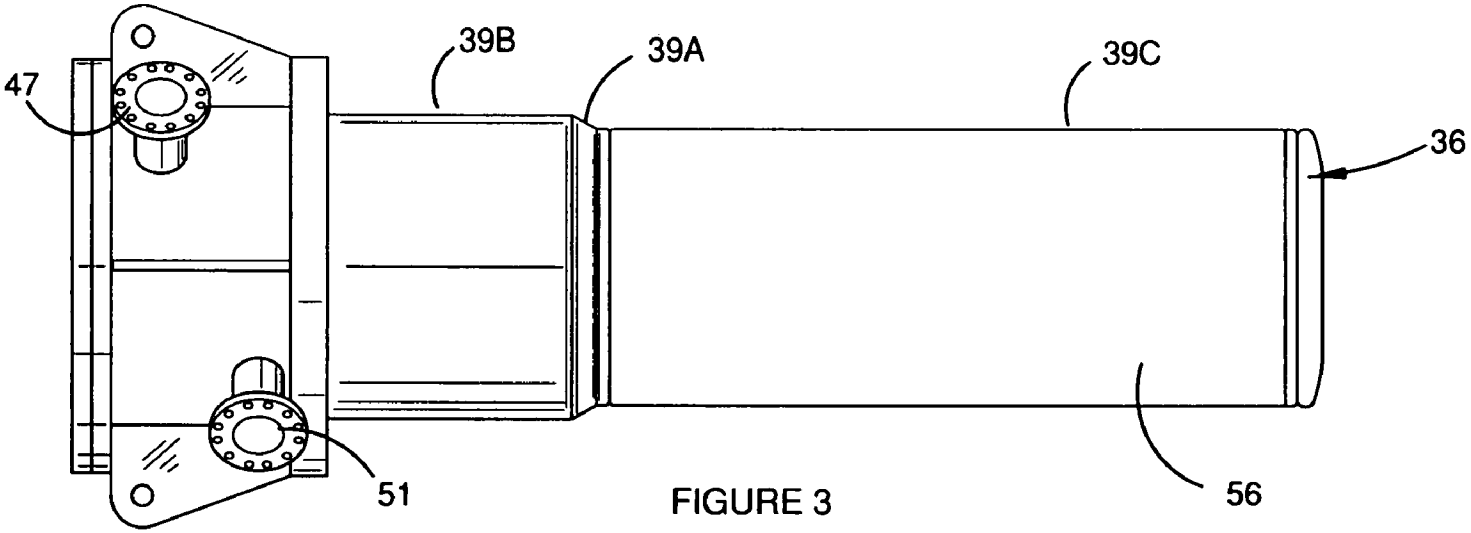
FIG. 3 is a side elevation of a forward part of another embodiment of the lance.
Figure 4:
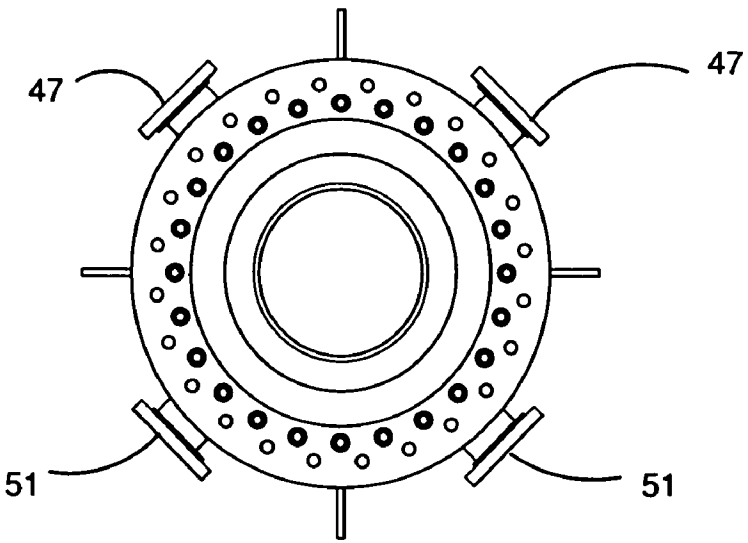
FIG. 4 is an end elevation of the forward part of the lance shown in FIG. 3.
Figure 5:
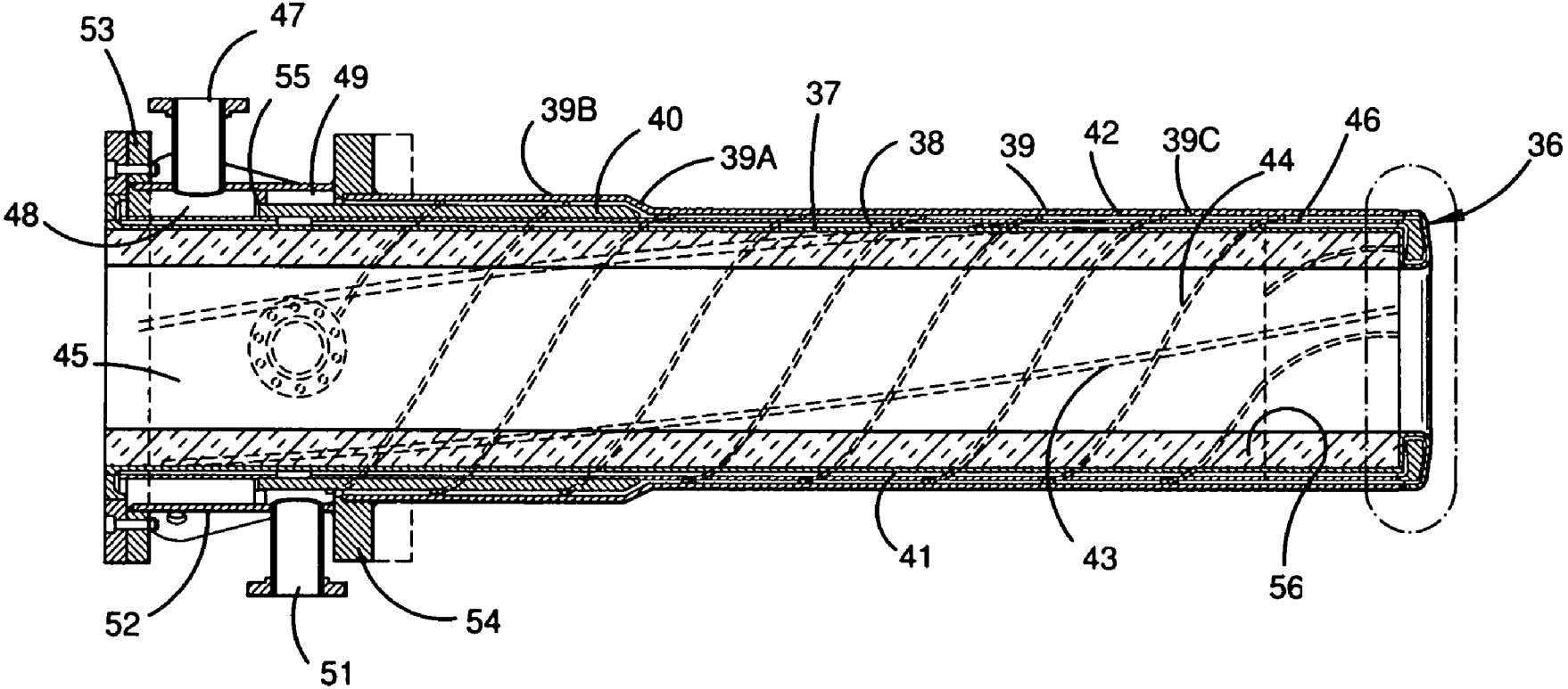
FIG. 5 is a longitudinal cross-section through the forward part of the lance shown in FIG. 3.
Figure 6:
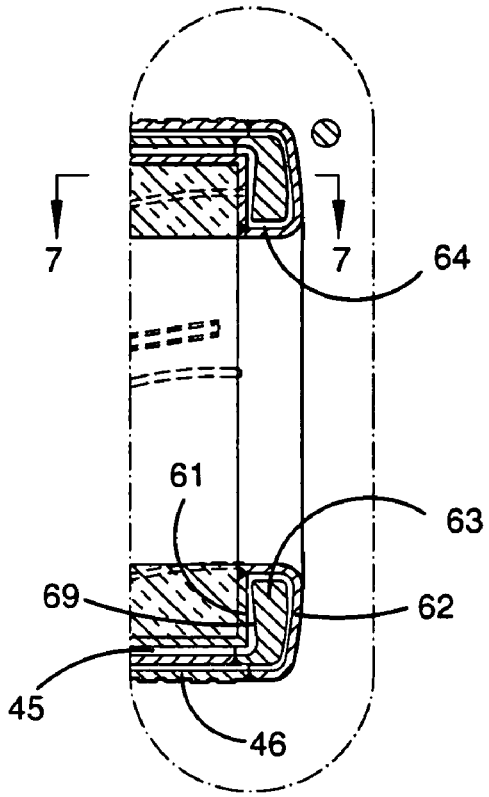
FIG. 6 is an enlargement of a forward part of the lance of FIG. 5 showing the construction of a lance tip—noting that the lance tip of the lance shown in FIG. 2 has the same construction.
Figure 7:
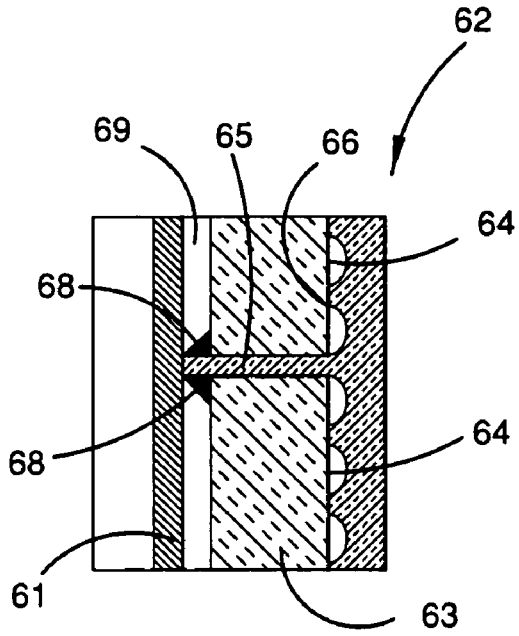
FIG. 7 is a cross-section on the line 7-7 in FIG. 6.
Figure 8:
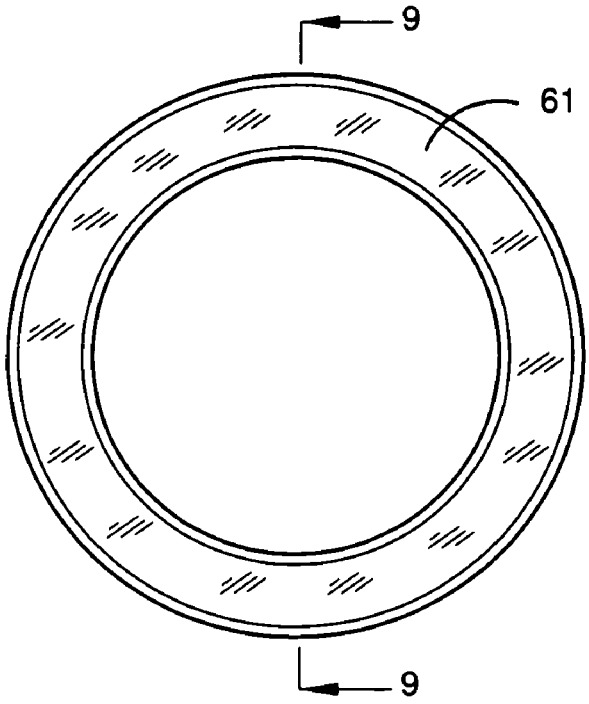
FIG. 8 illustrates an inner end component of the annular tip of the lance.
Figure 9:
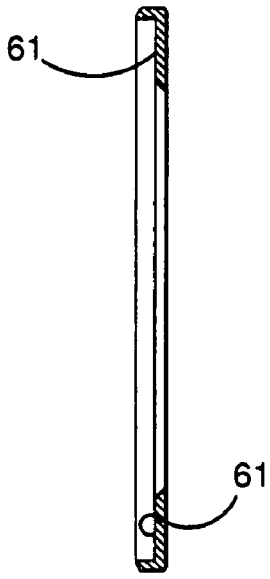
FIG. 9 is a cross-section on the line 9-9 in FIG. 8.
Figure 10:
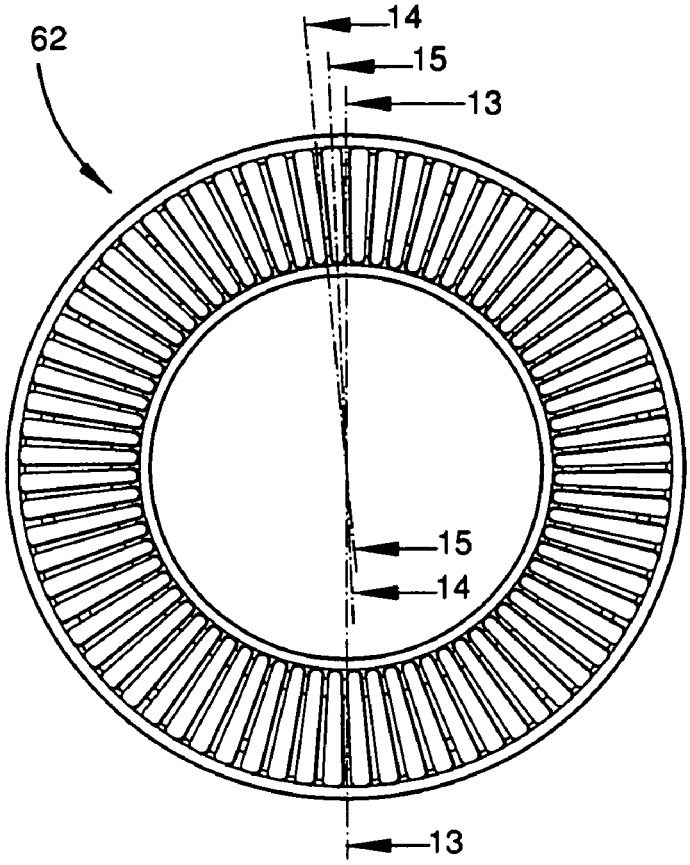
FIG. 10 illustrates an outer end component of the lance tip.
Figure 11:
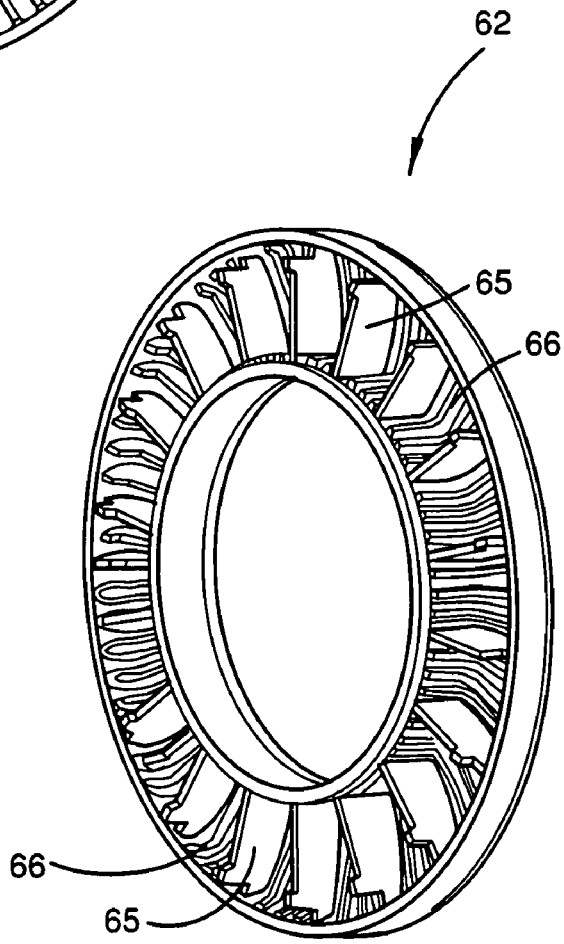
FIG. 11 is a perspective view of an inner face of the component shown in FIG. 10.
Figure 12:
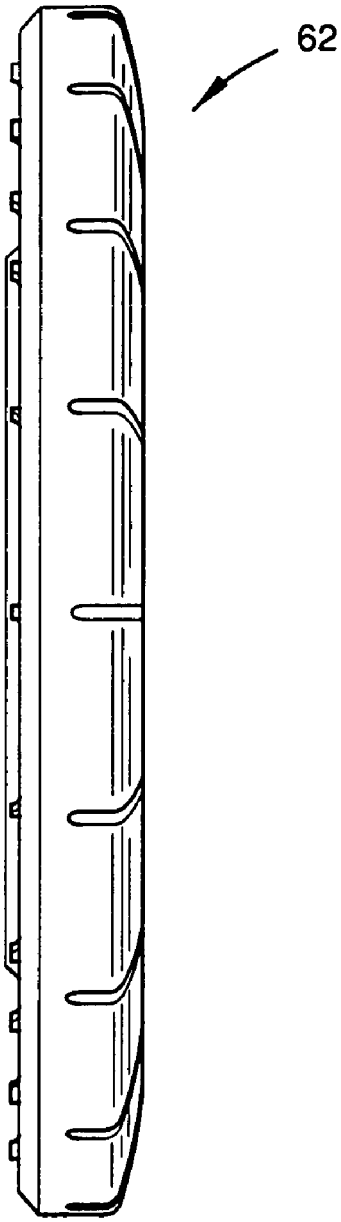
FIG. 12 is a diagrammatic side view of the component illustrated in FIG. 10.
Figure 13:
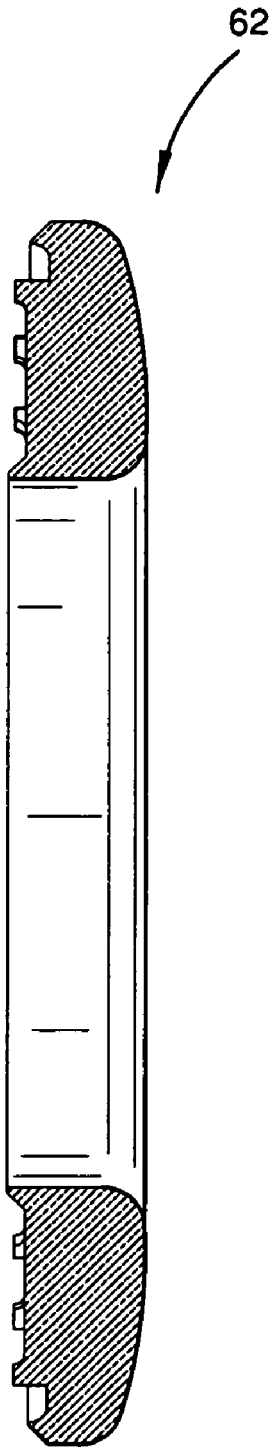
FIG. 13 is a cross-section on the line 13-13 in FIG. 10.
Figure 14:
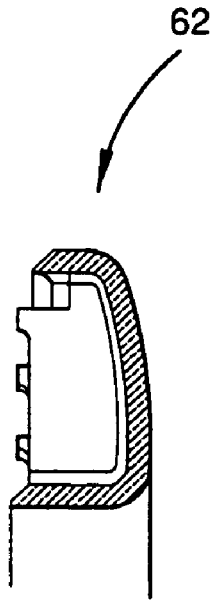
FIG. 14 is a cross-section on the line 14-14 in FIG. 10.
Figure 15:
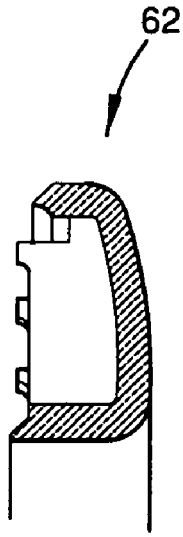
FIG. 15 is a cross-section on the line 15-15 in FIG. 10.
Figure 16:
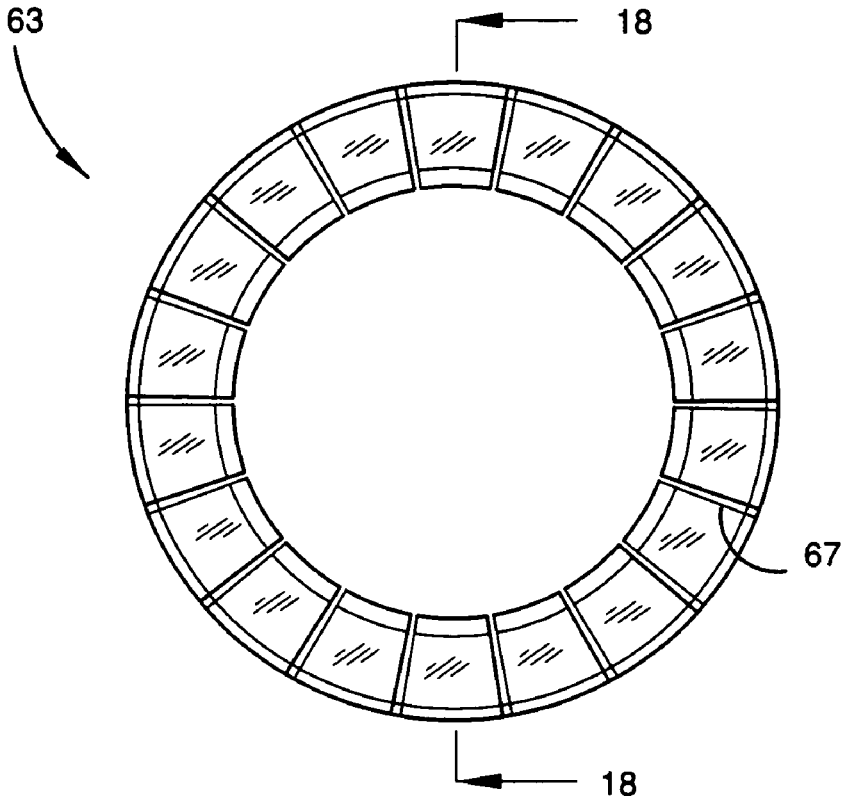
FIG. 16 illustrates a central component of the duct tip.
Figure 17:
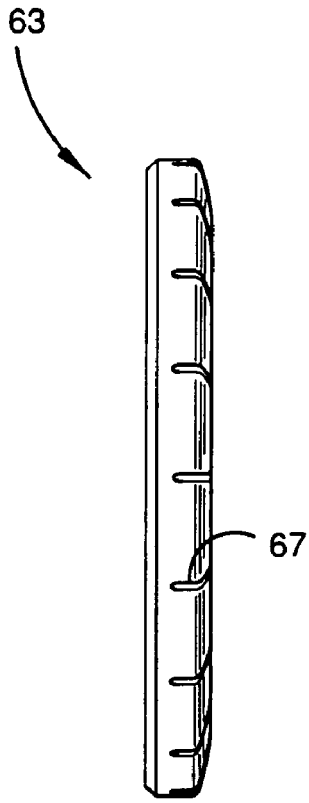
FIG. 17 is a side elevation of a component illustrated in FIG. 16.
Figure 18:
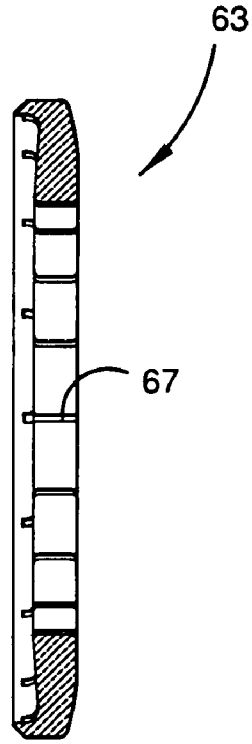
FIG. 18 is a cross-section on the line 18-18 in FIG. 16.

The construction of different embodiments of the hot air injection lance 26 is illustrated in FIGS. 2 to 18. FIG. 2 depicts a first embodiment and FIGS. 3-5 depict a second embodiment. Equivalent components have the same numbering in FIGS. 2-5. The lance tip shown in FIGS. 6-18 is described in the context of the second embodiment of the lance shown in FIGS. 3-5. The lance tip shown in FIG. 2 has the same construction.

Referring now to FIG. 2 lance 26 comprises an elongate duct 31 which receives hot gas through a gas inlet structure 32 and injects it into the upper region of vessel. An annular duct tip 36 is disposed at the forward end of the gas flow duct 31. The lance includes an elongate central tubular structure 33 which extends within the gas flow duct 31 from its rear end to its forward end. Adjacent the forward end of the duct, central structure 33 carries a series of swirl imparting vanes 34 for imparting swirl to the gas flow exiting the duct. Swirl vanes 34 may be formed to a four start helical configuration. Their inlet (rear) ends may have a smooth transition from initial straight sections to a fully developed helix to minimise turbulence and pressure drop.

The forward end of central structure 33 has a domed nose 35 which projects forwardly beyond the tip 36 of duct 31 so that the forward end of the central body and the duct tip co-act together to form an annular nozzle for divergent flow of gas from the duct with swirl imparted by the vanes 34.

The wall of the main part of duct 31 extending downstream from the gas inlet 32 is internally water cooled. This section of the duct is comprised of a series of three concentric steel tubes 37, 38, 39 extending to the forward end part of the duct where they are connected to the duct tip 36.

In the second embodiment as depicted in FIGS. 3-5 outer tube 39 is stepped at 39A so that the rear part 39B of that tube is of greater diameter than the forward part 39C. The rear part of intermediate tube 38 is thickened by an external sleeve 40 disposed within the rear portion 39B of the outer tube 39. An inner annular gap 41 of constant radial width is defined between the tubes 37, 38 and an outer annular gap 42 of a smaller constant radial width is defined between the tubes 38 39, both extending back from the tip through to the rear part of the duct, the outer annular gap 42 extending outwardly and back along the enlarged diameter rear portion 39B of the outer tube 39. The annular spaces 41, 42 are subdivided into inner and outer water flow passages by spirally extending inner divider bars 43 and outer spirally extending divider bars 44 respectively to form a series of four spirally extending inner flow passages 45 and a second series of spirally extending outer flow passages 46.

Cooling water is supplied to the inner passages 45 through two water inlets 47 and an annular inlet manifold 48 at the rear end of the duct. The water flows forwardly along the spiral passages 45 through to the tip 36. The cooling water then flows through the tip in the manner to be described later in this specification and back into the outer spirally extending passages 46 through which the water flows back to the rear end of the duct to exit through an outlet manifold 49 and two water outlets 51.

The inner water flow passages 45 extend in a four start helical array. The outer water flow passages 46 also extend in a four-start helical array but at a much shorter pitch than the spiral inner passages 45. More specifically the inner passages 45 extend through only approximately a quarter of a turn in extending from the rear end of the duct to the tip whereas the outer return passages 46 extend at a much shorter pitch through several turns in the distance from the tip back to the outlet manifold 49. This increases the residence time of the water within the outer passages 46 to enhance cooling of the outer parts of the duct. The radial width of the inner passages 45 is greater than the radial width of the outer passages 46 and the water flow is accelerated as it flows through the tip to enhance heat extraction through the tip, a constant volumetric flow being maintained through the narrower outer flow passages 46.

The inner divider bars 43 extend spirally around and are welded to the outer peripheral surface of the inner duct tube 37 and are flush fitted within the intermediate tube 38. The outer divider bars 44 forming the outer flow passages extend spirally around and are welded to the outer peripheral surface of the intermediate tube 38 (including the thickened rear portion 39B of the second embodiment) and are flush fitted within the outer duct tube 39 (including the enlarged diameter rear portion 39*b* of that tube).

The rear end of duct tube 39 is connected to a tubular housing 52 which receives the rear ends of the inner and intermediate tubes 37, 38 and carries the water inlets 47 and outlets 51. Housing 52 is provided with a rear flange 53 for connection to a gas inlet structure, such as inlet structure 32 in the first embodiment. Flange 53 is also connected to a mounting flange 54 for connection of the lance with a vessel. In the first embodiment, flange 54 suspends the lance in a vertical orientation within the vessel with all of its weight taken through the outer duct tube 39. The second embodiment may be positioned at an angle to the vertical. The rear end of the intermediate tube 38 is supported by a sliding seal 55 within housing 52 to permit relative longitudinal movements of the tubes on differential expansion of the various lance components.

The water cooled duct 31 is internally lined with internal refractory lining 56 that fits within the inner tube 39 of the duct and extends through to the water cooled tip 36 of the duct. The inner periphery of the duct tip 36 is generally flush with the inner surface of the refractory lining which defines the effective flow passage for gas through the duct.

The outer peripheral surface 56 of the forward part of outer tube 39, which in the second embodiment is, between the step 39A and the tip 36, may be roughened or provided with projections to serve as keying formations to promote accretion of slag on that surface, the slag serving as a protective layer against over heating of that surface.

Duct tip 36 is of annular formation and is comprised of an annular inner end component 61 and, an annular outer end component 62 and an annular central component 63 located between the inner and outer components. The outer end component 62 is provided with a plurality of radially extending ribs to divide the space between that outer end component 62 and the central component 63 into discrete radial passages 64 for flow of water around the tip as it flows from the spiral inflow passages 45 to the spiral outflow passages 46. The ribs on the outer end component 62 comprise a first series of ribs 65 spaced circumferentially of the outer end component and a second series of ribs 66 spaced circumferentially of the outer end component between the ribs 65 of the first series. The ribs 65 of the first series project from the outer component further than the ribs 66 of the second series. The central component 63 is provided with a series of radial grooves 67 to receive the ribs 65 of the first series, the shallower ribs of the second series merely abutting the central component 63 of the tip between the taller ribs 65 interfitted into the grooves 67. Outer end parts of the taller ribs 65 are wielded at locations 68 to the central component 63 to firmly fix the outer and central components 62, 63 together with the ribs 65, 66 subdividing a space between them into the discrete water flow passages 64. The space 69 between the inner tip component 61 and the central component 63 is undivided and so provides a single inwardly directed annular flow path from the inflow passages 45 to the discrete tip passages 64 which extend radially outwardly and back around the outer part of the tip toward the outflow passages 46. The space between the outer end components 62 and the central components 63 which is divided by the ribs 65, 66 into the discrete water flow passages 64 narrows in the radially outward directions along the passages so that the passages 64 decrease in effective cross-section in the radially outward direction to accelerate the cooling water as it flows through the tip.

The inner outer and central components 61, 62, 63 of the tip are welded together and are all made of a high purity copper so as to promote effective and even heat transfer through the tip and to avoid any movement between the components due to differential thermal expansion which might otherwise affect the formation and size of the discrete water flow passages through the tip.

Although the illustrated embodiment of the invention is a gas injection lance it will be appreciated that spiral water flow passages could also be employed in the water cooling jackets of the solids injection lances, for example lances of the general construction disclosed in International Application PCT/AU2005/001603.

It is accordingly to be understood that the invention is not limited to the constructional details of the illustrated embodiments and that many variations will fall within its scope.

By way of example, whist the embodiments of the lance are described as hot air injection lances, the invention is not so limited and extends to injection of any suitable gas and to injection of particulate material. By way of example, injected particulate material may include iron ore fines and/or carbonaceous material.

The invention claimed is:

1. An apparatus for injecting particulate and/or gaseous material into a metallurgical vessel for performing a metallurgical process, the apparatus comprising:

a duct through which to inject the material;

inner and outer water flow passages extending through an outer annular wall of the duct, the inner and outer water flow passages being for inflow of cooling water from a rear end to a forward end of the duct and for outflow of cooling water from the forward end to the rear end of the duct; and an annular duct tip disposed at the forward end of the outer annular wall and providing a water flow connection between the inner and outer water flow passages; and wherein the inner and outer cooling water flow passages are configured such that out flowing water passing from the duct tip to the rear end of the duct must travel through a longer flow path than inflowing water passing from the rear end of the duct to the duct tip.

2. The apparatus defined in claim 1 wherein the material injection duct is a gas flow duct for discharge of gas from the forward end of the duct.

3. The apparatus defined in claim 1 wherein the inner and outer water flow passages provide a greater total effective cross sectional area for inflowing cooling water than for out flowing water.

4. The apparatus defined in claim 3 wherein the outer water flow passages extend in spiral paths along the duct.

5. The apparatus defined in claim 4 wherein the outer water flow passages extend in a multi-start helical array extending continuously around the duct.

6. The apparatus defined in claim 4 or claim 5 wherein the inner water flow passages extend in spiral paths at a greater pitch than the spirally extending outer water flow passages so as to provide shorter flow paths for the inflowing water than the flow paths for the out flowing water.

7. The apparatus defined in claim 1 wherein there are an equal number of inner and outer water flow passages both configured to multi-start helical arrays extending continuously around the duct.

8. The apparatus defined in claim 7 wherein there are four inner water flow passages, and four outer water flow passages that are connected to the inner water flow passages via the tip.

9. The apparatus defined in claim 1 wherein the wall of the material injection duct is comprised of concentrically spaced apart inner, intermediate and outer tubes forming inner and outer annular spaces subdivided into the inner and outer water flow passages.

10. The apparatus defined in claim 9 wherein the inner annular space is subdivided into the inner water flow passages for water inflow by inner divider bars extending spirally around and welded to the outer peripheral surface of the inner duct tube and flush fitted within the intermediate duct tube.

11. The apparatus defined in claim 9 or claim 10 wherein the outer annular space is subdivided into the outer water flow passages for water outflow by outer divider bars extending spirally around and welded to the outer peripheral surface of the intermediate duct tube and flush fitted within the outer duct tube.

12. The apparatus defined in claim 9 wherein the inner annular space is wider in the radial direction than the outer annular space and the inner divider bars is correspondingly taller in the radial direction than the outer divider bars.

13. The apparatus defined in claim 1 wherein the material injection duct is lined internally with refractory material.

14. The apparatus defined in claim 1 wherein a plurality of flow directing vanes may be disposed within the forward end of the duct to impart swirl to gas discharging from the duct.

15. A direct smelting vessel that is fitted with the apparatus for injecting material into the vessel defined in claim 1.

16. The apparatus of claim 1, wherein one of the inner water flow passages or the outer water flow passages are for inflow of cooling water from the rear end to the forward end of the duct, and the other of the inner water flow passages or the outer water flow passages are for outflow of cooling water from the forward end to the rear end of the duct.

17. The apparatus of claim 1, wherein the inner water flow passages are for inflow of cooling water from the rear end to the forward end of the duct, and the outer water flow passages are for outflow of cooling water from the forward end to the rear end of the duct.

* * * * *